United States Patent [19]

te Velde et al.

[11] 3,954,065

[45] May 4, 1976

[54] OVERHEAD CONVEYOR WITH ACCUMULATION DOCK

[75] Inventors: Harm Frank te Velde; Gerardus Antonius Hafkenscheid, both of Eindhoven, Netherlands; Jan Marius Nierstrasz, Hsin-chu, China /Taiwan

[73] Assignee: U.S. Philips Corporation, New York, N.Y.

[22] Filed: May 28, 1974

[21] Appl. No.: 473,775

Related U.S. Application Data

[63] Continuation of Ser. No. 195,089, Nov. 3, 1971, abandoned.

[30] Foreign Application Priority Data

Nov. 6, 1970 Netherlands ..... 7016261

[52] U.S. Cl. ..... 104/172 S; 104/89; 104/252

[51] Int. Cl.[2] ..... B61B 13/00

[58] Field of Search ..... 104/88, 89, 91, 96, 104/99, 163, 172 S, 172 R, 252; 198/168

[56] References Cited

UNITED STATES PATENTS

| | | | |
|---|---|---|---|
| 2,940,400 | 6/1960 | Harrison | 104/172 S X |
| 2,956,514 | 10/1960 | Bishop | 104/172 S X |
| 3,623,538 | 11/1971 | Wakabayashi | 104/172 S |
| 3,724,391 | 4/1973 | te Velde | 104/172 S |
| 3,744,432 | 7/1973 | Price et al. | 104/172 S |

*Primary Examiner*—Robert G. Sheridan
*Assistant Examiner*—Randolph A. Reese
*Attorney, Agent, or Firm*—Frank R. Trifari; David R. Treacy

[57] ABSTRACT

An overhead conveyor having an accumulation dock and crabs which are movable in a track, which crabs can be temporarily arrested in the accumulation dock. For their movement the crabs can be coupled to a transporting chain circulating in the accumulation dock and provided with pivotable pawls which can be locked to a coupling element of the crabs. For arresting the crabs the pawls are unlocked by means of stationary pivotable uncoupler assemblies which are controlled by the crabs. The transport is started again by the successive automatic coupling of the crabs to the transporting chain.

7 Claims, 8 Drawing Figures

INVENTORS
HARM F. TE VELDE
GERARDUS A. HAFKENSCHEID
BY JAN M. NIERSTRASZ

Frank R. Trifari
AGENT

INVENTORS
HARM F. TE VELDE
GERARDUS A. HAFKENSCHEID
BY JAN M. NIERSTRASZ
AGENT

INVENTORS
HARM F. TE VELDE
GERARDUS A. HAFKENSCHEID
BY JAN M. NIERSTRASZ
AGENT

INVENTORS
HARM F. TE VELDE
GERARDUS A. HAFKENSCHEID
BY JAN M. NIERSTRASZ
AGENT

INVENTORS
HARM F. TE VELDE
GERARDUS A. HAFKENSCHEID
BY JAN M. NIERSTRASZ
AGENT

INVENTORS
HARM F. TE VELDE
GERARDUS A. HAFKENSCHEID
BY JAN M. NIERSTRASZ

AGENT

INVENTORS
HARM F. TE VELDE
GERARDUS A. HAFKENSCHEID
BY JAN M. NIERSTRASZ
Frank R. Trifari
AGENT

OVERHEAD CONVEYOR WITH ACCUMULATION DOCK

This is a continuation, of application Ser. No. 195,089, filed Nov. 3, 1971 and now abandoned.

The invention relates generally to overhead conveyors, and more specifically to such a conveyor having an accumulation dock with crabs which can travel in a track and driven pawls which circulate in a closed guide track extending parallel to the track. The crabs comprise a coupling element, the pawls and the coupling elements being movable relative to each other between a locking position and an unlocking position for the pairwise detachable coupling of the crabs to the pawls.

Such conveyors are used for the temporary accumulation of articles to be transported on a part of their transporting track; the crabs must be uncoupled from the driven pawls. Said uncoupling should preferably be carried out automatically.

In a known conveyor of this type the crabs are uncoupled in that they run into stationary preceding crabs. For that purpose the crabs comprise buffers, a sensing pin and a gear controlled by said pin for displacing a coupling element which can be locked with the driven pawls. The dimensions of the articles to be transported are restricted by the length of the buffers. Each crab must be provided with a gear, a sensing pin and buffers.

It is the object of the invention to provide a conveyor having a high reliability which, compared with the known conveyor, is simple and cheap and in which the uncoupling of the crabs is independent of the speed of transport and of the mass of the products to be transported and in which during uncoupling only small frictional forces occur.

According to the invention this object is mainly achieved by stationary uncoupler assemblies arranged along the path of movement of the crabs and the pawls for controlling the relative locking movements of the pawls and the coupling elements. By these measures a particular gear on each of the large number of crabs is not required. Since the uncouplers are necessary only in the accumulation dock, their number may be restricted to this part of the track. As soon as one crab is uncoupled, all the subsequent crabs are also uncoupled irrevocably and automatically, so that damage to the conveyor and to the products to be transported by accidentally non-uncoupled crabs is prevented.

One feature of the conveyor according to the invention, provides that the coupling elements are rigidly secured to the crabs, whereas the pawls are movable. By providing the crabs with a rigid coupling element, a very simple construction of the crabs will be sufficient. Any type of crab can be made suitable for the conveyor according to the invention by providing only the rigid coupling element.

The pawls can be driven in various manners. The most conventional drive is by means of a transporting chain beside or above the track. In this case, the pawls are pivotably suspended from the transporting chain and are movable into the locking position under the influence of gravity and into the unlocking position by the uncoupler assemblies. As a result of the pivotable suspension of the pawls, only a small force is necessary for the displacement thereof into the unlocking position against gravity, as a result of which the reliability of the conveyor is further increased. It is to be noted that in the known conveyor already mentioned the pawls are also driven by a transporting chain; in this case, however, the pawls are not movable relative to the chain.

A cheap and simple construction of the pawls and the coupling elements is obtained by providing that the coupling elements consist of a plate having a recess which can cooperate with a locking rib of the pawls.

According to a further feature of the invention, the uncouplers are rotatable about a vertical shaft and are movable into a rest position by the pawls and into an operative position by the coupling elements. As a result of this it is achieved that the movement of the uncouplers can be effected in a simple manner and without large frictional resistances.

A combined function of the uncoupler assemblies, both for unlocking the pawls and for arresting the crabs is possible in that the uncouplers are provided with an uncoupling brace directed against the direction of transport and cooperating with the pawls, with a control arm directed in the direction of transport and with an arresting cam, the arm and the cam cooperating with the coupling elements. Since the uncoupling brace and the control arm are directed in opposite directions it is achieved that a pawl coupled to a crab is unlocked therefrom by an uncoupler which is retained in the operative position by a preceding stationary crab. Jamming of the uncoupler is prevented by a predetermined sequence of the uncoupling cycle in which an uncoupler is operated by the coupling element of a coupled crab, the pawl locked with the coupling element is then unlocked by the next uncoupler assembly and finally the crab is arrested by the locking cam of the second uncoupler.

According to a further aspect of the invention the last uncoupler assembly, viewed in the direction of transport, can be remotely controlled and be blocked in the operative position. The accumulation of the crabs can be started, for example, by bringing the last uncoupler assembly into the operative position manually and blocking it in said position. By the remote control and the blocking of said uncoupler, the accumulation can be automated.

After uncoupling, the crabs must be arrested. For this purpose the arresting cam on the uncoupler is used, which in the operative position cooperates with a cam on the coupling elements. When articles are suspended from the crabs, they tend to start rocking as a result of the coupling and uncoupling. These rocking movements are attenuated by the crabs being provided with a non-rotatable frame serving as a protection for the products to be conveyed. The frames are constructed so that they can run into each other on straight tracks without it being possible for the articles to touch each other or to damage each other.

Another aspect of the invention provides that the pitch between successive pawls is larger than the pitch between successive stationary crabs. As a result of this successive crabs are successively coupled to successive pawls and renewed conveying is rapidly started.

In order that the invention may be readily carried into effect, one embodiment thereof will now be described in greater detail, by way of example, with reference to the accompanying drawings, in which:

FIGS. 1*a* and 1*b* show a conveying diagram with an accumulation dock.

Figure 1A:
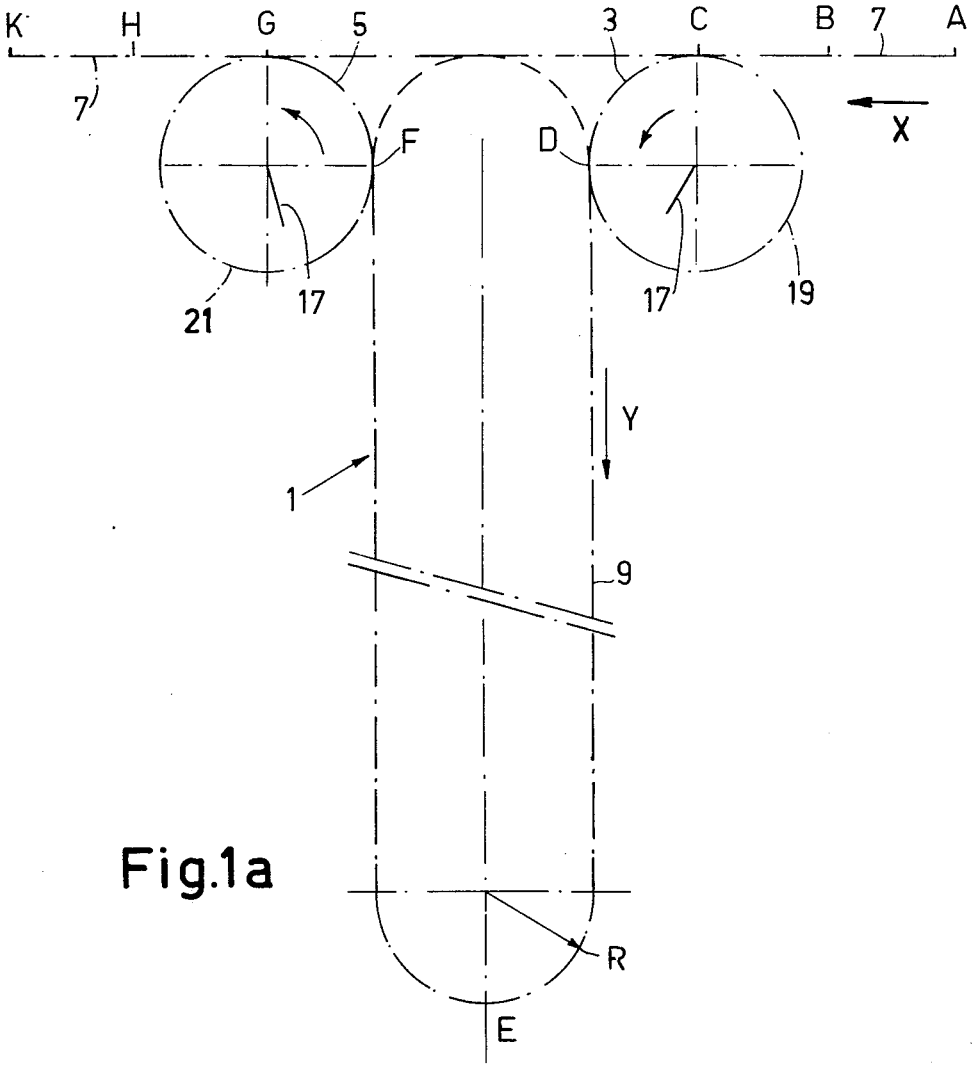
Figure 1B:
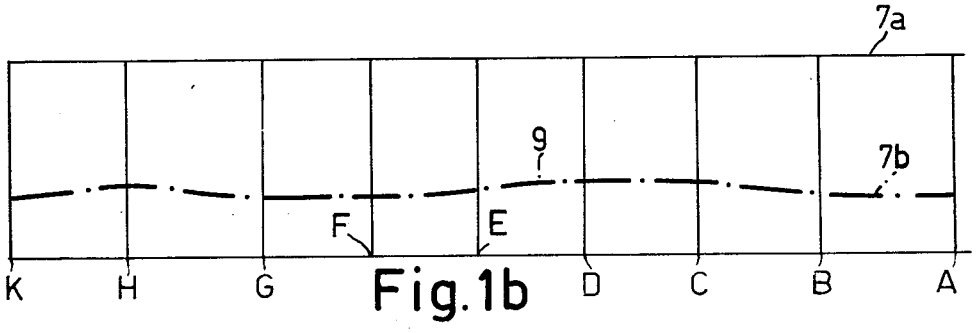

FIGS. 1*a* and 1*b* show a part of a conveying diagram having a loop-shaped accumulation dock 1 which is connected to a main track 7 via switches 3 and 5. The direction of transport in the main track 7 and in the accumulation dock 1 is denoted by the arrows X, Y.

Figure 2:
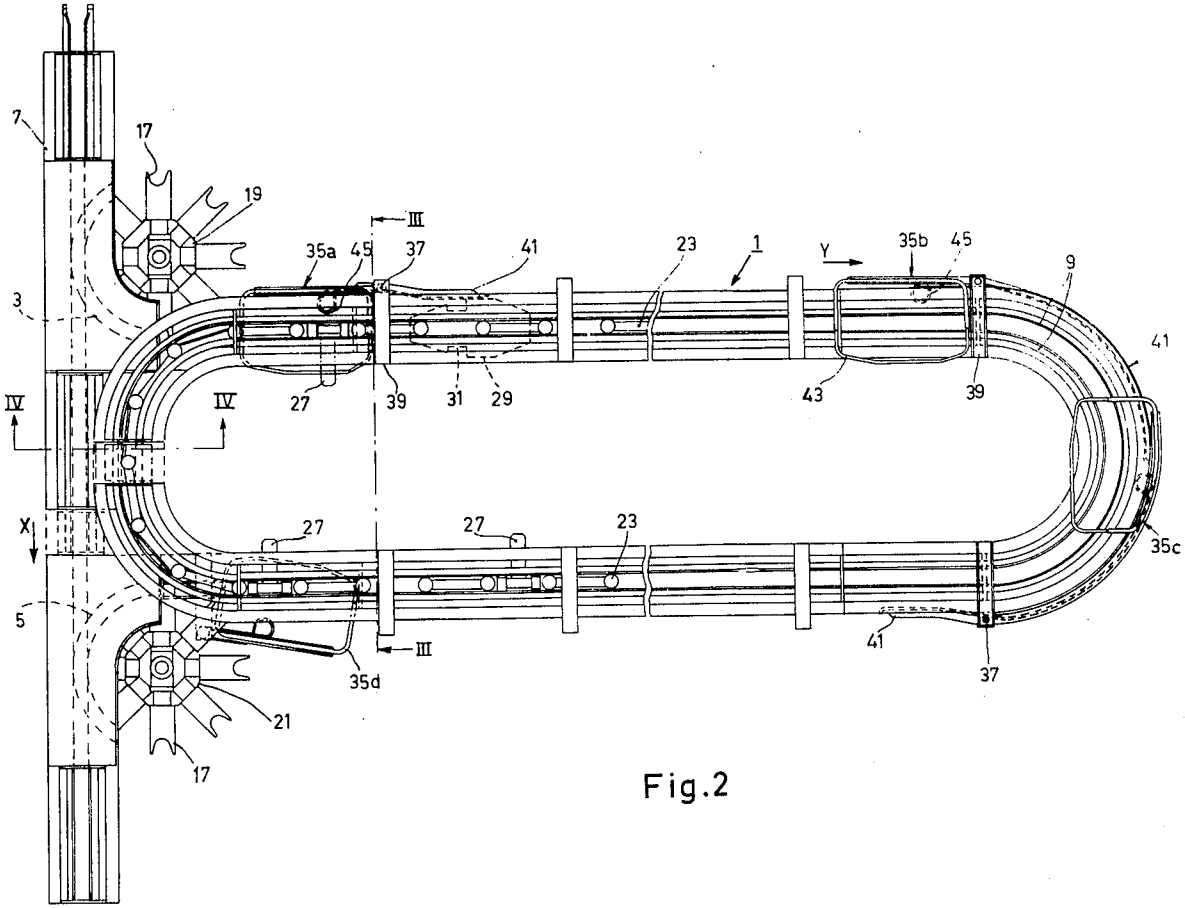
FIG. 2 is a plan view of an accumulation dock.
Figure 3:
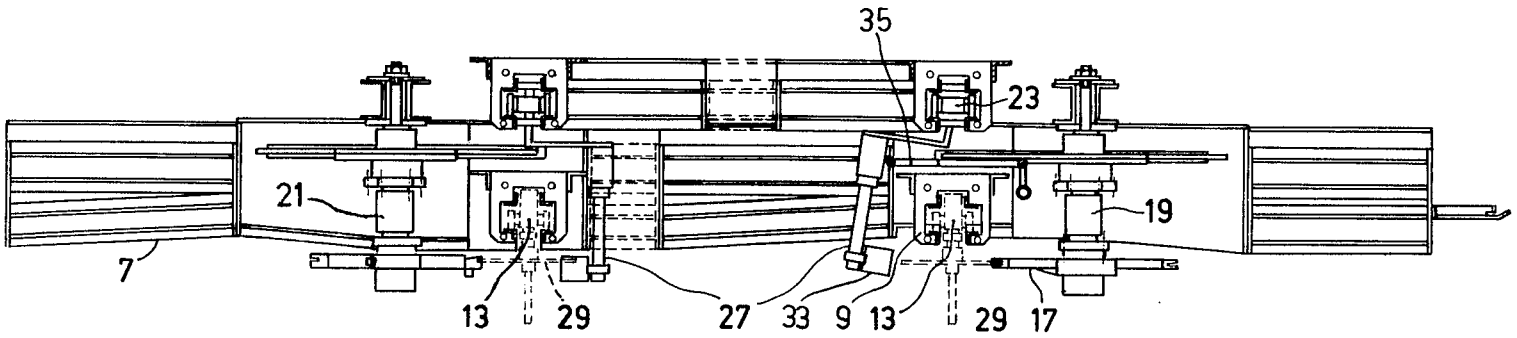
FIG. 3 is a sectional view through the accumulation dock taken on the line III—III of FIG. 2.
Figure 4:
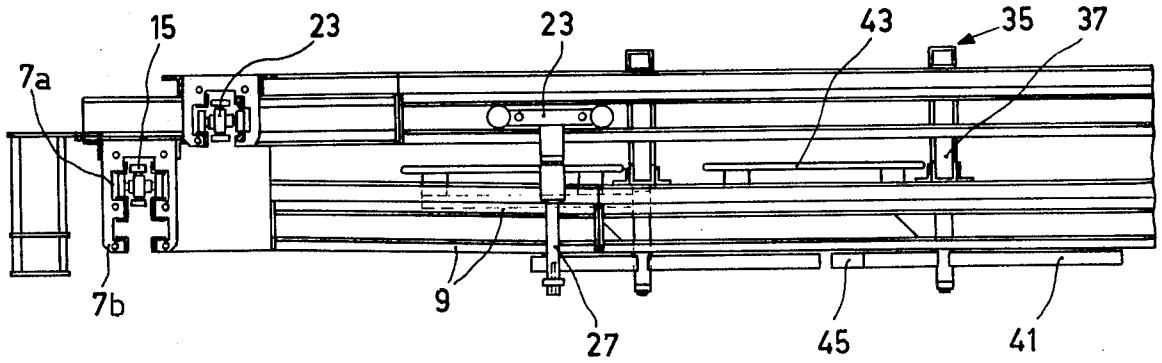
FIG. 4 is a sectional view taken on the line IV–IV of FIG. 2.
Figure 5:
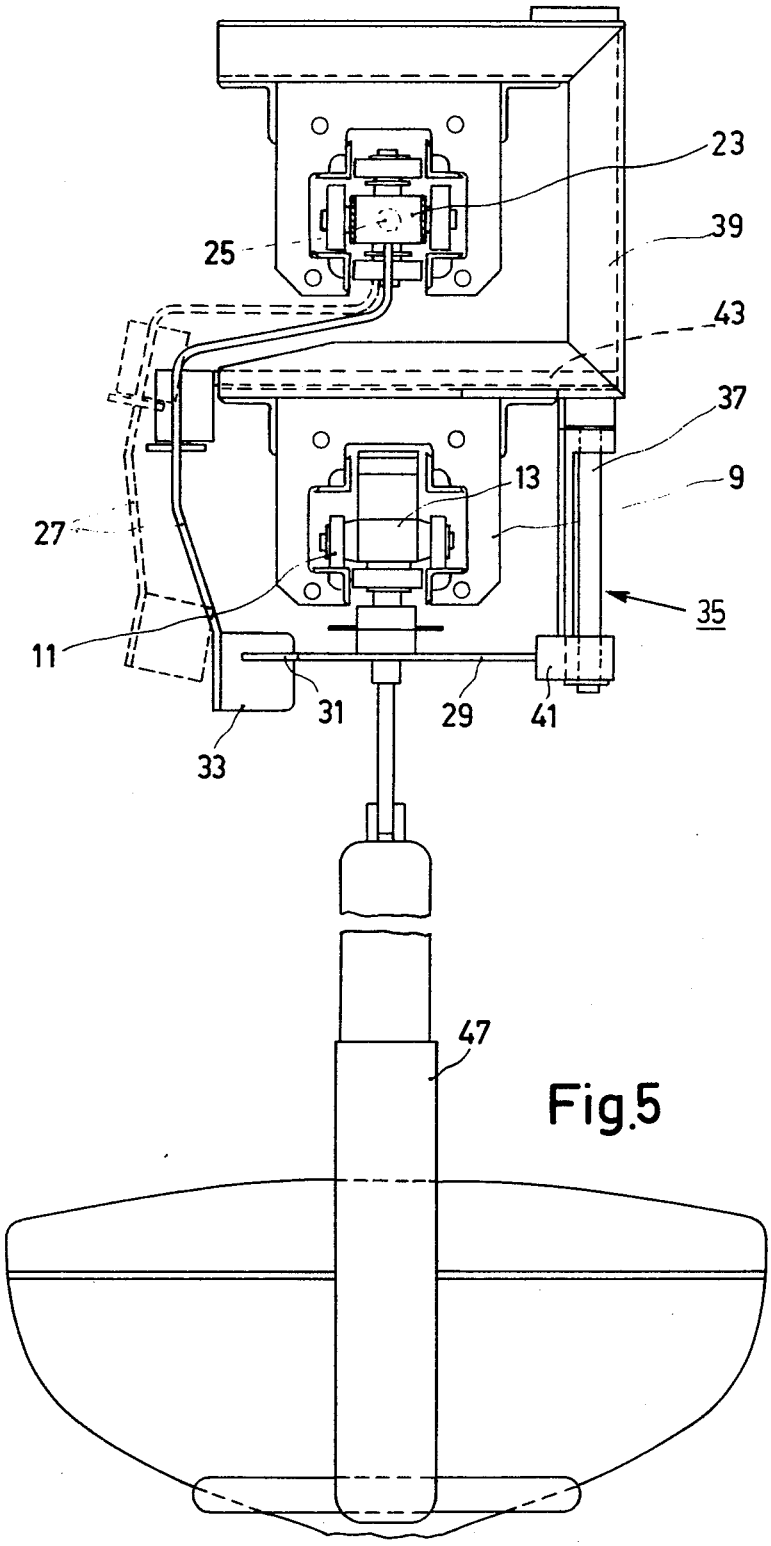
FIG. 5 is a partial sectional view on an enlarged scale of the accumulation dock with a crab.

FIGS. 2, 3 and 4 show in detail the accumulation dock 1 having a closed track 9 composed of profile iron which constitutes a guide for the rollers 11 of crabs 13. In the main track 7 the crabs 13 are driven by a transporting chain 15 and switched, in the switch 3 by the pawls 17 of a switch wheel 19, from the main track 7 to the track 9 where a number of crabs 13 can be arrested. The crabs 13 can be returned to the main track 7 by means of a switch wheel 21 in the switch 5. Displacement of the crabs 13 in the accumulation dock 1 can be carried out in various manners, for example, manually or by gravity. In the device according to the invention, however, a transporting chain 23 which in this embodiment is arranged above and parallel to the track 9 is used for this purpose. Pawls 27 pivotable about a horizontal shaft 25 are arranged at regular distances on the transporting chain 23. Each crab 13 comprises a plate-shaped coupling element 29 having a recess 31 with which a rib 33 on the pawls 27 can cooperate for coupling the crabs 13 to the transporting chain 23. A plan view of one coupling element is shown in FIG. 2 in broken lines. In FIG. 5 a pawl 27 is shown in the locking position, coupled to a crab 13. The broken line denotes the position in which the pawl 27 is in the unlocking position. On the left-hand side of FIG. 3 is shown a pawl 27 locked to a coupling element 29, the unlocked position being shown on the righthand side.

The movements of the pawl 27 are controlled by uncoupler members 35 placed along the track 9, FIG. 2 showing four uncouplers 35*a* to 35*d*. Each uncoupler member can rotate (or pivot) about a vertical shaft 37 on a stationary part 39 of the conveyor and comprises a control arm 41 which is directed in the direction of transport and an uncoupling brace 43 which is directed in the opposite direction. The uncoupling braces 43 are arranged above the crabs 13 while the control arms 41 are situated at the level of the plate-shaped coupling elements 29. The operation of the pawls, the uncouplers and the coupling elements is as follows: under the influence of gravity the pawls 27 tend to assume a locking position in which the rib 33 engages the recess 31 of a coupling element 29; as a result of this the associated crab 13 is coupled to the transporting chain 23. The uncouplers 35 are freely rotatable about the vertical shaft 37 and can assume a rest position in which the uncoupling braces 43 are outside the path of movement of the pawls 27, while the control arms 41 are in the path of movement of the coupling elements 29.

FIG. 2 shows the uncoupler 35*d* in the rest position. When a crab 13 coupled to the transporting chain 23 passes an uncoupler 35 which is in the rest position, the plate-shaped coupling element 29 touches the control arm 41 as a result of which the uncoupler 35 experiences a rotating movement about the vertical shaft 37 so that the uncoupling brace 43 projects into the path of movement of the pawls 27 and assumes an operative position. In FIG. 2 the uncouplers 35*a* and 35*c* are shown in this position. Since, however, the control arm 41 and the uncoupling brace 43 are directed in opposite directions, the pawl 27 has already passed the uncoupling brace 43 before the same performs the pivotal movement. The uncoupling brace 43 is returned to the rest position by a subsequent pawl 27. Uncoupling does not take place and the crab 13 is further conveyed by the transporting chain 23, all successive uncouplers 35 being passed in the same manner. During passage of a series of crabs 13, the uncouplers 35 perform an oscillatory pivotal movement about the shaft 37 between the rest position and the operative position. However, once a crab 13 has been arrested, it is retained by an arresting cam 45 on the uncouplers 35 in cooperation with the coupling element 29. The coupling element 29 of the stationary crab 13 is in contact with the control arm 41 of the subsequent uncoupler 35 as a result of which same is retained in the operative position. A subsequent crab 13 coupled to the transporting chain 23 is uncoupled in that the pawl 27 which drives this crab is rotated into the unlocked position by the second uncoupler 35. The coupling element 29 engages the locking cam 45 of the second uncoupler and also holds the subsequent third uncoupler in the operative position.

Figure 6:
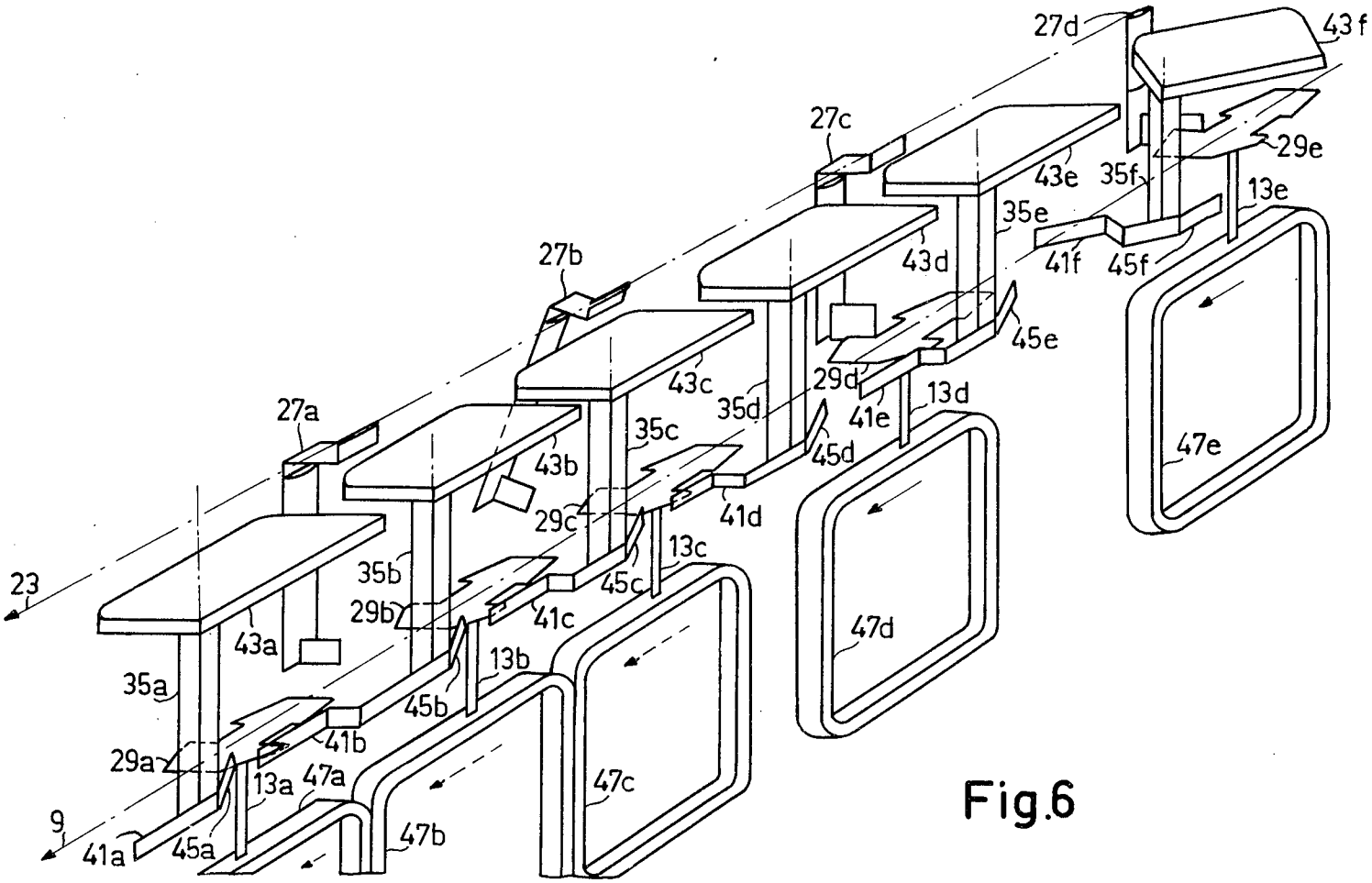
FIG. 6 is a perspective view of a number of crabs during accumulation.

FIG. 6 shows diagrammatically the various positions of a number of crabs 13*a*–13*e*, uncouplers 35*a*–35*f* and pawls 27*a*–27*d*, components which are not essential being omitted so as to avoid complexity of the drawing. 9 denotes diagrammatically the track and 23 the transporting chain. Of the crabs 13 themselves only the coupling element 29 and a frame 47 secured to the crabs are shown.

The crab 13*a* is stationary because of uncoupler 35*a* is maintained in the operative position shown, for example by pulling the arm 41*a* by means of a compressed air cylinder. The arresting cam 45*a* of said uncoupler arrests the coupling element 29*a*, while the uncoupling brace 43*a* ensures that the passing pawls 27 pass the coupling element 29*a* in the unlocked position. The coupling element 29*a* forces the second uncoupler 35*b* to remain in the operative position shown. The situation for the crabs 13*b* and 13*c* is the same as for the crab 13*a*. The crab 13*d* is moving and is driven by the pawl 27*c*; the coupling element 29*d* is just setting the uncoupler 35*e* in the operative position; the crab 13*d* will be arrested later against the arresting cam 45*d* of the uncoupler 35*d*, while the pawl 27*c* is forced in the uncoupled position by the uncoupler 35d.

The crab 13*e* also moves and is driven by the pawl 27*d*. Due to the weight of the pawl, the uncoupler 35*f* is in the rest position shown. Later on the coupling element 29*e* will set said uncoupler in the operative position. The crab 13*e* is then arrested against the lock cam 45*e*, while the pawl 27*d* will be uncoupled by the uncoupling brace 43*e*.

Setting the crabs in motion again is carried out as follows: uncoupler 35*a* is reset to the rest position so that the crab 13*a* is no longer arrested. The first pawl 27*a* to arrive will couple the crab 13*a* to the transporting chain 23. When the crab 13*a* starts, the second uncoupler 35*b* can also return to the rest position. The first pawl 27*b* to pass forces said uncoupler in the rest position and takes along the crab 13*b*. All the subsequent crabs will successively be coupled in a similar manner to the transporting chain 23.

The assembly is constructed so that when the pawl 27*n* takes along the crab 13*k*, the pawl 27*n* + *m* takes along the crab 13*k* + *m*. Consequently, the setting in motion of a whole row of stationary crabs can be carried out particularly rapidly. A condition for this is that the pitch between successive pawls is larger than the pitch between successive stationary crabs.

As a result of the locking of the ribs 33 of the pawls 27 in the recesses 31 of the coupling elements 29 it is achieved that the crabs are always driven, both in ascents and in descents, at the chain speed and independently of various forces acting on the crabs and caused by, for example frictional resistances in inclines and curves, weight components in the direction of transport of the products to be conveyed, smaller obstacles on the track, poorly travelling rollers of the crabs, and so on.

Figure 7:
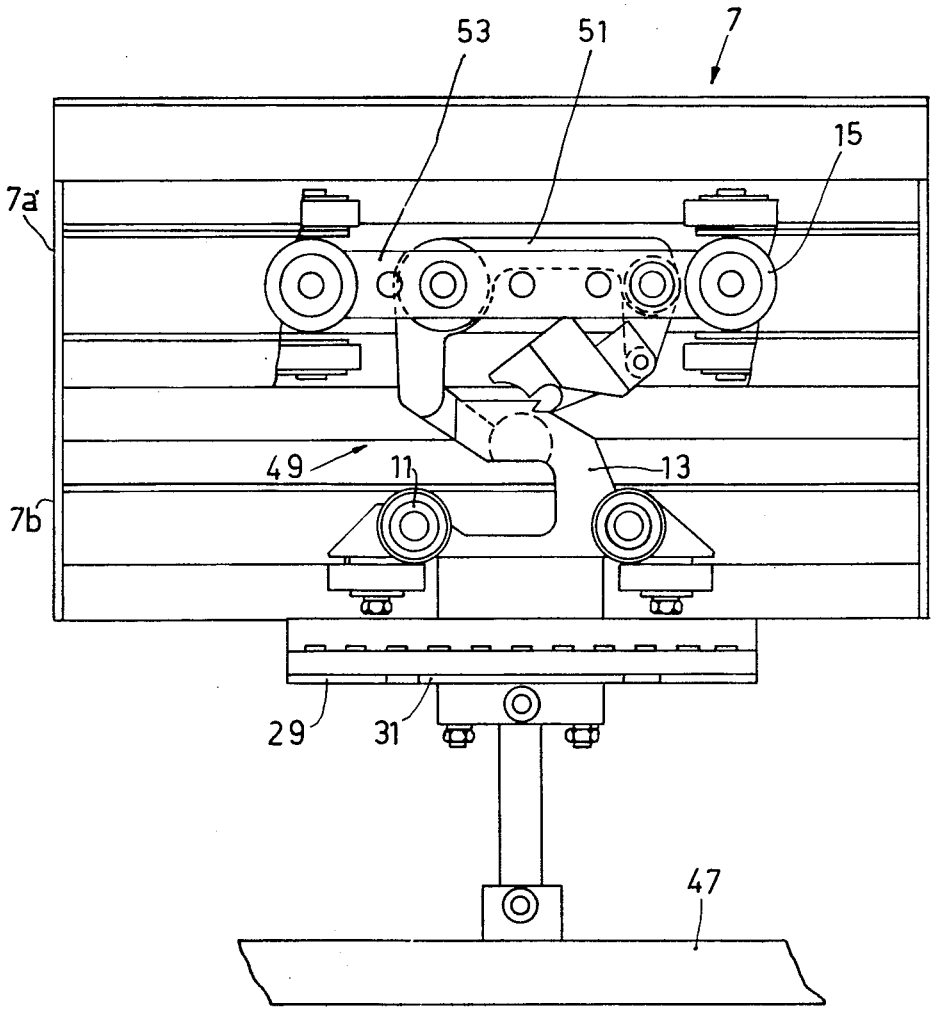
FIG. 7 is a partial sectional view of a double trolley used in the device according to the invention.

Crabs of a variety of types can be made suitable in a simple manner for use in the conveyor according to the invention, only by providing the plate-shaped coupling element 29 at the correct level. For the combination with the conveyor according to the invention, however, the double trolley 49 shown in FIG. 7 is particularly suitable. In this case, the crab 13 described so far is detachably coupled to the driving crab 51 which is secured to the links 53 of the transporting chain 15. During normal transport in the main track 7, the crab 13 suspends freely from the driving crab 51. Uncoupling the crab 13, transferring it from the main track 7 to the accumulation dock 1 and returning to the main track 7, as well as the renewed coupling to the driving crab 51 is carried out on section A–K of the transport diagram shown in FIGS. 1*a* and 1*b*, FIG. 1*b* showing the variation in height of the main track 7 and the track 9. On the section A-B-C-G-H-K the main track 7 is constructed as a double track having an upper track 7*a* of constant height and, at the level of the track 9, a lower track 7*b* of variable height. On the horizontal section A–B which is constructed as a double track, the crab 13 touches with its rollers 11 the lower track 7*b* which changes into the track 9. FIG. 7 shows the double trolley 49 in the double-track section A–B. In the case of automatic control of the switch 3 in the section C–D, electronic, electro-optical or other automatically operating sensing means for controlling the switch 3 are provided on said double-track section A–B. On the section B–C, the lower track 7*b* ascends so that the crab 13 is moved upwards relative to the driving crab 51. In the switch 3 the crab 13 is driven by the pawls 17 of the switch wheel 19. In the accumulation dock 1 the crabs 13 which are guided in the track 9 and are driven by the transporting chain 23, are moved in the above-described manner and temporarily arrested. After the renewed coupling of the crabs 13 to the transporting chain 23, they are transferred by the pawls 17 of the switch wheel 21 through the switch 5 to the section F–G to the ascending double-track section G–H and raised relative to the driving crabs 51. On the descending double-track section H–K the crabs 13 are again lowered and coupled to the driving crabs 51.

The conveyor according to the invention enables arbitrary crabs to be temporarily transferred in any numbers to an accumulation dock for working the conveyed products, for the temporary storage of products, for controlling the production process, for removing damaged products, and so on.

The accumulation docks may have any shape with ascents and descents to 45°, accumulation taking place, however, at horizontal parts and preferably on straight tracks. For the accumulation in curves special measures are necessary. As shown in FIG. 2, the uncoupler assemblies 35*b* and 35*c* are for that purpose provided with particularly long control arms 41*b* and 41*c*, because in the curve less space is available and the pitch must locally become larger to keep the products spaced apart.

FIG. 1*a* shows only one accumulation dock; the number, the variation and the capacity of the accumulation docks, however, can be adapted to the needs in a simple manner.

For a rapid and disturbance-free operation of the conveyor, the speeds of the transporting chain 15 in the main track 7 of the switch wheels 19 and 21 and of the transporting chain 23 in the accumulation dock 1 are synchronized so that $V_1 = (K + 1/2)\ V_2$, where $V_1$ is the speed of the transporting chain 23, $V_2$ is the speed of the transporting chain 15 and $K$ is a positive integer.

All the tracks, both those for the crabs and driving crabs and those for the transporting chains are composed of profile irons which constitute a guide for rollers with which the crabs and driving crabs as well as the transporting chains are provided.

What is claimed is:

1. An overhead conveyor with an accumulation dock comprising crabs arranged for travel within a main track, said crabs comprising a coupling element rigidly secured thereto, driven pawls carried on a closed guide track extending parallel to said main track, the pawls and the coupling elements being movable relative to each other between a locking position and an unlocking position for detachable coupling of the crabs to the pawls, pawl engagement means carried by said coupling element for receiving said pawl when said pawl and element are coupled, and uncoupler members mounted for pivotal movement about a stationary vertical shaft between rest and operative positions and arranged along the path of movement of the crabs and the pawls for controlling the relative locking movements of the pawls and the coupling elements, said uncouplers being movable into a rest position by engagement with said pawls in which position a pawl moving past said uncoupler will not cause uncoupling of the crab and pawl, and into an operative position by engagement with the coupling elements, in which position a part of said uncoupler member will engage said pawl to cause uncoupling.

2. A conveyor as claimed in claim 1, wherein said part of said uncoupler member comprises an uncoupling brace directed against the direction of transport and cooperating with the pawls, a control arm directed in the direction of transport, and an arresting cam, the arm and the cam cooperating with the coupling elements.

3. A conveyor as claimed in claim 1 wherein the last uncoupler member, viewed in the direction of transport, can be remotely controlled and be blocked in the operative position.

4. A conveyor as claimed in claim 1, wherein the spacing between successive pawls is larger than the spacing between successive crabs when motion of said crabs has been arrested by successive uncoupler members.

5. An overhead conveyor with an accumulation dock comprising a main track and a guide track extending parallel to said main track, crabs arranged for travel within said main track, said crabs comprising a coupling element rigidly secured thereto, driven pawls carried in a direction of travel on said guide track, the pawls being pivotably suspended from the guide track so as to be movable with respect to the coupling elements between a locking position and an unlocking position for detachable coupling of the crabs to the pawls, said pawls being biased toward said locking position, pawl engagement means carried by said coupling element for receiving said pawl when said pawl and element are coupled, a stationary shaft and uncoupler members mounted for pivotal movement about said stationary shaft between rest and operative positions and arranged along the path of movement of the crabs and the pawls for controlling the relative locking movements of the pawls and the coupling elements, said uncoupler members having a first contacting means extending in a direction opposite to said direction of travel of said crabs for controlling said relative locking movements, and a second contacting means extending in said direction of travel of said crabs for sensing presence of a crab at a given position along said main track and moving said uncoupler member from the rest to the operative position in response to said presence, wherein said uncoupler member being in said operative position in the absence of a crab in said given position contact of a pawl with said first contacting means moves said uncoupler member to the rest position.

6. A conveyor as claimed in claim 5, wherein said uncoupler member comprises an arresting element extending opposite to said direction of travel and disposed, when said uncoupler is in the operative position, to block the path of movement of the coupling element of a crab which has been uncoupled from a pawl by the first contacting means of the same uncoupler member.

7. A conveyor as claimed in claim 5, wherein said pawls are biased toward the locking position by unbalanced force of gravity sufficient to move said uncoupler member to the rest position.

* * * * *